United States Patent [19]

Duve et al.

[11] 4,207,500

[45] Jun. 10, 1980

[54] CUT-OFF ARRANGEMENT FOR AND METHOD OF PROTECTING A BALLAST-STARTER CIRCUIT FROM HIGH PRESSURE SODIUM LAMP CYCLING MALFUNCTION

[75] Inventors: George Duve, Washington; Daniel DiCarlo, Hackettstown, both of N.J.

[73] Assignee: Area Lighting Research, Inc., Hackettstown, N.J.

[21] Appl. No.: 969,384

[22] Filed: Dec. 14, 1978

[51] Int. Cl.[2] ..... H05B 41/231; H05B 37/03

[52] U.S. Cl. ..... 315/119; 315/289; 315/360; 315/362; 315/DIG. 2

[58] Field of Search ..... 315/91, 106, 119, 127, 315/289, 290, 360, DIG. 2, DIG. 5, DIG. 7, 362; 361/86, 91

[56] References Cited

U.S. PATENT DOCUMENTS

| | | | |
|---|---|---|---|
| 3,500,128 | 3/1970 | Liepins | 315/360 X |
| 3,699,385 | 10/1972 | Paget | 315/DIG. 5 |
| 3,771,014 | 11/1973 | Paget | 315/DIG. 7 |
| 4,072,878 | 2/1978 | Engel et al. | 315/DIG. 5 |
| 4,107,579 | 8/1978 | Bodine, Jr. et al. | 315/DIG. 7 |

*Primary Examiner*—Eugene R. LaRoche
*Attorney, Agent, or Firm*—Kirschstein, Kirschstein, Ottinger & Cobrin

[57] ABSTRACT

A cycling cut-off arrangement and method of protecting from burn-out a ballast-starter of a luminaire having a power source normally connected to the ballast-starter, and a high pressure sodium lamp across which the ballast-starter supplies voltage of predetermined magnitude to operate the lamp, in the event of a cycling malfunction wherein the lamp is extinguished and the ballast-starter applies a voltage of greater magnitude than the predetermined magnitude across the extinguished lamp. The voltage across the lamp is detected, and a current signal is generated when the voltage magnitude across the lamp reaches a threshold magnitude which is greater than said predetermined magnitude. In response to the generation of the current signal, the power source is disabled from the ballast-starter to protect the latter from damage. A latching-type switch is employed to maintain the disabled condition of the ballast-starter, and a manual reset push button serves to reset the ballast-starter back to its normally-connected condition with the power source. A timer switch generates a timer signal lasting for a predetermined time period which begins upon power resumption after a power malfunction of duration less than said predetermined time period. The timer signal makes the latching-type switch inoperative during the predetermined time period to thereby prevent disablement of the ballast-starter in the event of a power malfunction.

18 Claims, 4 Drawing Figures

CUT-OFF ARRANGEMENT FOR AND METHOD OF PROTECTING A BALLAST-STARTER CIRCUIT FROM HIGH PRESSURE SODIUM LAMP CYCLING MALFUNCTION

BACKGROUND OF THE INVENTION

1. Field of the Invention

The present invention relates generally to luminaires of the type having a high pressure sodium lamp, a source of electrical power, and ballast-starter means normally connected to the power source and operative for supplying voltage of predetermined magnitude across the lamp to operate the latter. More particularly, the present invention relates to a cycling cut-off arrangement for and method of protecting the ballast-starter means from damage in the event of a cycling malfunction wherein the lamp is extinguished and the ballast-starter means applies a voltage of magnitude greater than said predetermined magnitude across the extinguished lamp.

2. Description of the Prior Art

Luminaires having a high pressure sodium lamp and a ballast-starter circuit normally connected to a source of electrical power and operative for supplying voltage to the lamp to operate the latter are well known, particularly for street lighting purposes. The operating characteristics of this sodium lamp are such that, as the lamp ages, some of the electrode material will deposit on the arc tube. This causes the arc tube to retain heat and, in turn, the internal pressure and the arc tube voltage will increase. When the arc tube voltage becomes so high that the ballast-starter circuit can no longer supply it, the lamp goes out. The lamp will restrike after it has cooled down sufficiently. This phenomenon of alternate lighting and extinguishing of the sodium lamp is commonly known as cycling.

Cycling is a major problem in the maintenance of street lighting. The ballast-starter circuit used in conventional luminaires will burn out if a cycling condition persists for thirty or more days. Unfortunately, it is very difficult to detect if a lamp is cycling in the field. By the time a serviceperson has arrived at the lamp location, the lamp may have come on again. The serviceperson will be very hesitant to remove an operating lamp, because replacement is expensive. Of course, if the cycling lamp is not replaced, the ballast-starter circuit will eventually also have to be replaced, thereby increasing the total maintenance cost of the system.

At present, a lamp replacement maintenance program serves to avoid the cycling problem. An average lamp working lifetime is determined, and the lamps are replaced before this working lifetime has expired. Since different lamps have different aging characteristics, this type of replacement program is a very expensive procedure for solving the cycling problem.

Summary of the Invention

1. Objects of the Invention

Accordingly, it is the general object of the present invention to overcome the above-mentioned drawbacks of the prior art.

Another object of the present invention is to protect ballast-starter circuits from burn-out in the event of a cycling malfunction.

Still another object of the present invention is to reliably detect the existence of a cycling malfunction in the field.

Yet another object of the present invention is to substantially reduce the maintenance costs involved in high pressure sodium lamp lighting systems.

2. Brief Summary of the Invention

In keeping with these objects and others which will become apparent hereinafter, one feature of the invention resides, briefly stated, in a cycling cut-off arrangement for and method of protecting from damage a ballast-starter means of a luminaire of the type having a source of power normally connected to the ballast-starter means, and a high pressure sodium lamp across which the ballast-starter means supplies voltage of predetermined magnitude to thereby operate the lamp, in the event of a cycling malfunction wherein the lamp is extinguished and the ballast-starter means applies a voltage of magnitude greater than said predetermined magnitude across the extinguished lamp. The arrangement and method comprises sensor means for detecting the magnitude of the voltage across the extinguished lamp, and for generating an electrical current signal when the magnitude of the voltage cross the extinguished lamp reaches a threshold magnitude which is greater than said predetermined magnitude; and means responsive to the generation of the electrical current signal for disabling the power source from the ballast-starter means to thereby protect the latter from damage in the event of a cycling malfunction.

In accordance with the above-recited features of the present invention, the ballast-starter circuit is protected from burn-out. By disabling the ballast-starter circuit from the power source as soon as the cycling condition is detected, conventional burn-out problems are safely and reliably avoided.

In further accordance with the present invention, the disabling means comprises a latching-type switch which switches from a working state to a cut-off state in which the ballast-starter circuit is disconnected from the power source. The disabling means maintains the cut-off switch in the cut-off state until a manual reset push button is actuated to re-establish the working state. This feature reliably puts the serviceperson on notice that a cycling malfunction has been detected by the arrangement and method of the present invention. There is no longer any hesitancy about replacing the sodium lamp. Maintenance costs are dramatically reduced.

Of course, the cycling cut-off arrangement need not only be operative in the cycling malfunction situation described above, but may also be operative to sense whenever the voltage across the lamp exceeds a predetermined voltage value. This predetermined value may be selected to be less than the voltage which exists across the extinguished lamp in the event of a cycling malfunction. In this case, the sensing of the lamp voltage above the predetermined value can be used to indicate that the lamp output or efficiency is no longer at its normal rating, that the user may wish to change lamps at this time, as well as the fact that a cycling malfunction may be imminent. The user maintains the option of operating the cut-off arrangement for cycling purposes, or for the purpose of indicating an unacceptable loss of efficiency for his lighting system.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Description of the Preferred Embodiments

Figure 1:
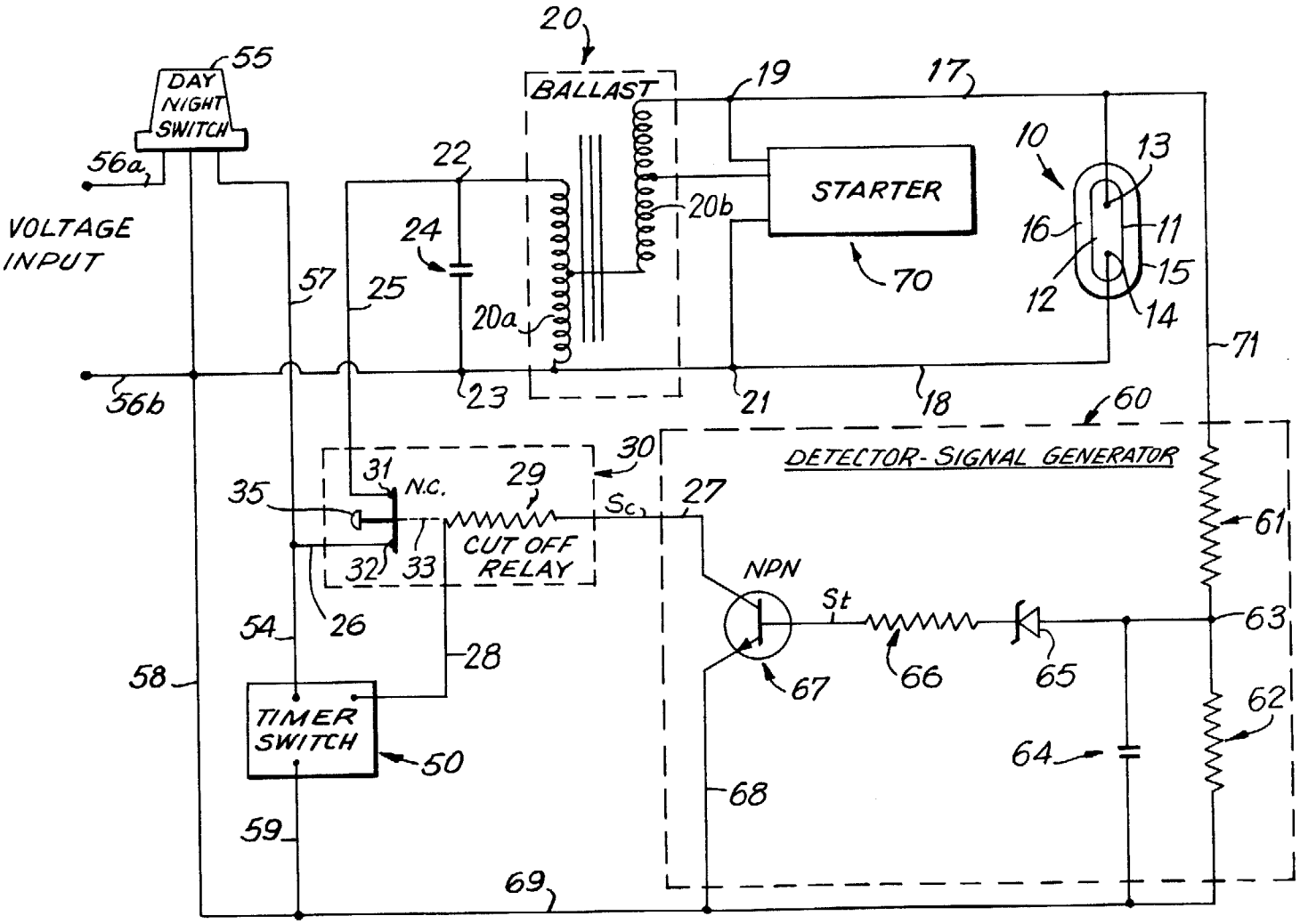
FIG. 1 is a partially diagrammatic, partially schematic diagram of the cut-off arrangement and method in accordance with one embodiment of the present invention.

Referring now to the drawings, and more particularly to FIG. 1 thereof, reference numeral 10 generally identifies a high pressure sodium lamp. Lamp 10 comprises an arc tube 11 having an interior space 12 which is partially filled with a sodium amalgum. Electrodes 13, 14 are located at opposite end regions and within tube 11. Small amounts of other substances such as mercury and argon are also enclosed within the tube 11 to facilitate arcing when the proper voltage is applied across the electrodes 13, 14. A thermally-insulating glass envelope 15 surrounds the tube 11 with clearance 16. This clearance area 16 is evacuated and serves to maintain the tube 11 hot in a manner analogous to a vacuum bottle.

To initiate standard operation, a cold unlit lamp is started by applying a high voltage on the order of 2000 v across the electrodes 13, 14. In a few seconds, the arc tube 11 will break down, that is a current will begin to flow through the tube. At this point, the tube 11 will have almost no impedance. A ballast-starter circuit is conventionally connected in cascade with the lamp in order to limit the current to a magnitude which will not destroy the lamp.

As shown in FIG. 1, the ballast 20 has two coils—a primary and a secondary. Ballast input terminals 22, 23 are located opposite ends of primary coil **20*a*. Power correction factor capacitor 24 is connected between terminals 22, 23. One end of secondary coil 20*b* is connected to some point in the primary coil 20*a* in autotransformer fashion, the location of the tap being dependent upon the input voltage rating of the ballast. Ballast output terminal 19 is located at the other end of secondary coil 20*b*; and ballast output 21 is connected to ground input terminal 23**.

A starter 70 is connected across ballast output terminals 19, 21 and has another input terminal connected to some point in the secondary coil **20*b*, the location of this tap being dependent upon the input voltage rating of the ballast. This ballast-starter combination is entirely conventional in this art and is operative for supplying voltage along conductors 17, 18 at the appropriate magnitude to the electrodes 13, 14 for starting and later for operating the lamp 10**.

As noted above, the ballast-starter means 20, 70 limits the current during start-up to a value which will not destroy the lamp. The passage of current causes the gases within the tube 11 to ionize and emit light, typically a yellow-orange light in the case of sodium lamps. As the temperature of the arc tube 11 increases due to the current flow, the voltage across electrodes 13, 14 likewise increases due to the increased pressure within the tube. As the arc tube voltage increases, the ballast-starter is operative for decreasing the current flow. Eventually, an equilibrium point will be reached when the temperature of the arc tube 11 is such that the heat and light energy output from the arc tube will equal the electrical energy input from the ballast-starter external circuit. At this equilibrium point, the temperature of the tube 11 will no longer increase, and the arc tube voltage and current will likewise stabilize. Typical temperatures for the already lit lamp are in the order of 2000° F.–3000° F.; typical arc tube voltage for the already lit lamp is on the order of 100 v.

In the event of a power malfunction, that is, if the electrical power supplied to the lamp is interrupted for a very short time, the operating characteristics of the high pressure sodium lamp are such that the arc tube 11 will cool very rapidly at first. For purposes of explanation, the tube typically cools down to temperatures on the order of 1000° F. in about three seconds after a power failure. This causes the ions to recombine, and the flow of current stops. In short, a power failure of short duration will cause the lamp to extinguish almost immediately. At this point, the ballast will supply the ballast open circuit voltage across the electrodes 13, 14. This voltage is higher than the normal arc tube working voltage.

When the power returns, the extinguished lamp will not re-ignite or restrike because the arc tube is still at a fairly high temperature (e.g. 1000° F. after three seconds), although not hot enough to keep the lamp gases ionized, and the corresponding internal tube pressure is too high to permit electrons to be emitted from the electrodes 13, 14. As the arc tube cools down, the pressure inside the tube decreases until the pressure is low enough for the applied voltage across electrodes 13, 14 to re-ignite the tube. Typically, it takes on the order of three or more minutes for a lamp to cool down enough to restrike. Usually, the lamp must cool down to a particular temperature of about 200° F.–300° F. to restrike.

The sodium amalgum in the arc tube has the tendency over a long period of time to combine with the arc tube material. Therefore, to insure a long working lifetime, excess sodium is enclosed within the arc tube. The mercury in mercury vapor lamps does not have this tendency, and, therefore, no excess mercury is used in that type of lamp. This causes a major difference in these lamps. All of the mercury is vaporized in a mercury lamp when it reaches its operating point. The high pressure sodium lamp, on the other hand, still has liquid sodium present when it is at its operating point. The excess sodium will continue to vaporize as the arc tube temperature increases. This will increase the pressure in addition to the pressure increase due to the Gas Law. The arc tube voltage will rise with the increased pressure. This fact causes the high pressure sodium lamp to have a rapid increase in arc tube voltage when its operating temperature is increased. The mercury vapor lamp, on the other hand, is more stable because its internal pressure is only governed by the Gas Law.

The above-described characteristics for a high pressure sodium lamp prevail during the working lifetime of this lamp. However, as this lamp ages, some of the electrode material, typically tungsten, will deposit on the arc tube. The inner wall of the tube comes coated with an electrode material film, and this causes the aging tube to lose less heat as compared to a new tube. The resulting temperature increase raises the internal pressure and concomitantly raises the arc tube voltage. When the arc tube voltage becomes so high, for example on the order of 165 v, that the ballast-starter circuit can no longer supply it, the lamp goes out. At this point, the ballast will supply the ballast open circuit voltage across the electrodes 13, 14. This voltage is higher than the normal arc tube working voltage. The extinguished lamp will restrike only after it has cooled down in a manner analogous to that described above in the case of a power malfunction. This phenomenon caused by aging of the lamp, wherein the lamp alternately goes on and goes off, is commonly known as cycling.

As noted above, cycling is a major problem in lighting fixtures, because the ballast-starter circuits will burn out if cycling persists for thirty or more days. A serviceperson has great difficulty in detecting cycling in the field, because the lamp may have come on again when the serviceperson arrives on the scene. It is very costly for a serviceperson to wait until one full cycling cycle, on the order of ten minutes or so, has been completed for each and every lamp in the lighting system.

In general accordance with the arrangement and method of the present invention, lamp cycling is detected, and the ballast-starter circuit is disconnected from the electrical power source of the lamp in response to such detection of the cycling malfunction. The cycling lamp is permanently shut off, thereby making it easy for a workman to visually spot this lamp. When the lamp is replaced, a push button switch is manually actuated to reset the cycling cut-off arrangement.

As shown in FIG. 1, a detector-signal generator circuit 60 is operative for detecting the magnitude of the voltage across the lamp 10, and for generating an electrical current signal when the magnitude of the voltage across the lamp reaches a threshold magnitude. The voltage signal at electrode 13 is conducted by conductor 71 to resistors 61 and 62 which constitute a voltage divider. As noted above, cycling of the lamp is accompanied by an increase in arc tube voltage. The lamp will become unstable when the arc tube voltage is above 165 v. The normal operating arc tube working voltage is about 100 v. When the lamp extinguishes, the ballast open circuit voltage, on the order of 200 v or more, is applied across the lamp. The resistors 61, 62 are so selected that the zener diode 65, which is connected in series with tap 63 of the divider, will fire when the lamp voltage is between 165 v and 200 v. The capacitor 64 serves as a shunt for the starting voltage spikes.

Once the zener diode is conducting, a trigger signal $S_t$ will flow through current-limiting resistor 66 and into the base of a NPN transistor or electronic switching means 67. The emitter of transistor 67 is connected by conductor 68 to ground wire 69, and once the transistor 67 conducts, an electrical current signal $S_t$ will be conducted from the collector of the transsistor along conductor 27 to the cut-off relay switch or disabling means 30.

The specific structural features of the cut-off relay or latching-type switch 30 will be described in detail below in connection with the description of FIGS. 3 and 4. At this time, it is important to note that FIG. 1 diagrammatically shows a heater coil 29 which receives the current signal $S_c$ from conductor 27 and conducts it along conductor 28 to timer-switch 50, and thereupon to ground wire 69 via conductor 59. The heater coil 29 is operative after a short time delay along line-of-action 33 to break electrically conductive contact between normally-closed and electrically-conducting contacts 31, 32. The short time delay of the coil 29 is on the order of 30 seconds to about 45 seconds and generally serves to prevent tripping of the cut-off relay switch when the lamp is started without having a power failure. Reset push button 35 is manually actuatable to re-establish the electrically conductive contact between contacts 31, 32.

Contact 31 is electrically connected by conductor 25 to ballast input terminal 22. Contact 32 is electrically connected by conductor 26 to timer-switch 50 via conductor 54, and also to one side of day/night switch 55 via conductor 57. The other side of switch 55 is connected to main power line **56*a*. Switch 55 is also grounded via conductor 58 to ground wire 69, ground power line 56*b*, and grounding conductor 59. The day/night switch is essentially a conventional photosensor device and measures the amount of available light. Input voltage is conducted along power lines 56*a*, *b*, and voltage is admitted to cut-off relay 30 only when switch 55 has determined that a "night" condition exists. When a "day" condition exists, there is no need for the lamp to be lit and consequently switch 55 open-circuits power line 56*a***.

The specific structural features of timer-switch 50 will be described in detail below in connection with the FIG. 2 description. At this time, it is important to note that the timer of timer-switch 50 generates a timer signal having either of two magnitudes. At one magnitude, the switch of timer-switch 50 closes; and at the other magnitude, the switch opens. In FIG. 1, the timer generates said one magnitude at all times, except upon resumption of power after a power malfunction, and thereafter for a predetermined time period, e.g. on the order of five minutes. Consequently, the switch is closed at all times other than said predetermined time period, and the electrical current signal $S_c$ passes through coil 29 and through timer-switch 50 to ground. During said predetermined time period, the timer generates said other magnitude. The current signal $S_c$ cannot pass through heater coil 29 due to the open condition of switch 50 during this predetermined time period. The timer-switch 50 serves to prevent disablement of the ballast-starter circuit in the event of a power malfunction.

In standard operation, the detector-signal generator circuit 60 is inoperative, because the zener diode only fires when its threshold value is reached. In the event of cycling, the arc tube voltage increases. When the lamp extinguishes, the ballast open circuit voltage is present across the lamp. Once the zener diode fires due to the fact that its threshold voltage has been reached because of the above-normal voltage across the lamp, a trigger signal is generated. This trigger signal causes the electronic switch 67 to conduct. Now, the electrical current signal passes through coil 29 and causes the latter to heat up. After a short time delay, typically on the order of 45 seconds, electrical conduction between contacts 31, 32 is broken and remains broken in this cut-off state.

This sequence of events only occurs if the timer-switch 50 is closed. This timer-switch 50 has a predetermined time period lasting on the order of five minutes which begins after resumption of input power. The function of the timer-switch is to permit starting of the lamp and to prevent tripping of contacts 31, 32 into the cut-off state after a short power failure. If a power failure of short duration occurs, e.g. less than five minutes, the lamp will extinguish immediately. When the power returns, the lamp is too hot to restrike. Therefore, the ballast-open circuit voltage will be present across the lamp. This situation looks identical to the cycling malfunction situation. The timer-switch resets substantially instantly after power returns. Thus, a five minute interval must pass before current can again flow through coil 29. By this time, the lamp has cooled down sufficiently to restrike. The voltage detected by the detector circuit 60 decreases; the current flowing through zener diode 65 decreases; transistor 67 is cut-off; and the current signal flow through coil 29 stops.

Figure 2:
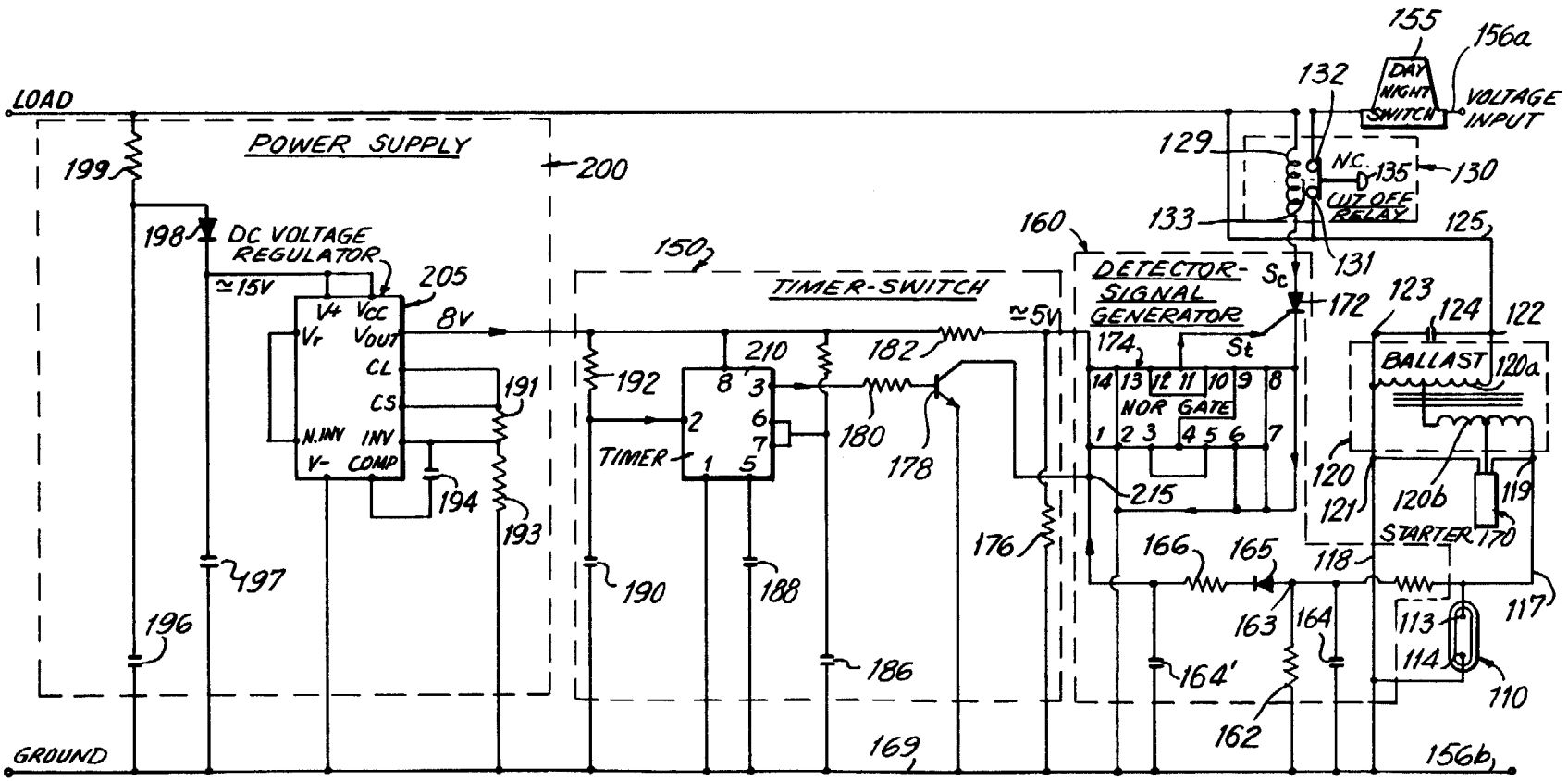
FIG. 2 is a partially diagrammatic, partially schematic diagram of the cut-off arrangement and method in accordance with another embodiment of the present invention.

Turning now to FIG. 2, it will be recognized that power lines 156*a*, 156*b* are analogous to lines 56*a*, 56*b*; day/night switch 155 is analogous to switch 55; cut-off relay switch 130, contacts 131, 132, heater coil 129, line-of-action 133 and push button 135 are analogous to switch 30, contacts 31, 32, coil 29, line-of-action 33, and button 35; ballast 120, primary coil 129, secondary coil 120*b*, input terminals 122, 123, output terminals 119, 121, power factor correction capacitor 124, conductors 125, 117 and 118, and starter 170 are all analogous to ballast 20, coil 20*a*, coil 20*b*, terminals 22, 23, terminals 19, 21, capacitor 24, conductors 25, 17 and 18, and starter 70; high pressure sodium lamp 110 and electrodes 113, 114 are analogous to lamp 10 and electrodes 13, 14, respectively. Inasmuch as the structure and function of the identified circuit elements of FIG. 2 are identical to that already described for the identified circuit elements of FIG. 1, a detailed description of the structure and function of these circuit elements of FIG. 2 is not believed to be necessary and is, therefore, not provided for the sake of brevity.

FIG. 2 has been conveniently subdivided into three circuit portions: the detector-signal generator circuit 160, the timer-switch circuit 150 and the power supply circuit 200. Circuit 160 senses and monitors the magnitude of the voltage across lamp 110, and generates an electrical current signal $S_c$ when the voltage magnitude reaches a threshhold magnitude which is greater than the normal working voltage across the lamp. As before, this current signal is supplied to heater coil 129 of cut-off relay 130 to trip the latter into the cut-off state wherein the ballast-starter means 120, 170 is disconnected from the power being supplied on input power lines 156*a*, *b*.

The voltage signal at electrode 113 is conducted to a voltage divider consisting of resistors 161, 162. Capacitor 164 prevents starting voltage spikes from entering the diode 165. The arc tube working voltage for a good lamp is a fixed value, generally on the order of 100 v. The voltage divider resistors reduce this working voltage to a small value, e.g. about 4 v. Tap 163 is connected to diode 165 which rectifies the reduced AC signal. Current-limiting resistor 166 and capacitor 164' serve to help filter and remove the AC signal ripple.

The filtered signal is thereupon applied to input terminal 1 of a fourteen-terminal NOR gate 174 which is an integrated circuit chip (CD 4001). Terminal 2 is connected to terminals 6, 7 and 13; terminal 3 is connected to terminal 5; terminal 4 is connected to terminal 9; terminal 6 is connected to terminal 7; terminals 7 and 8 are connected to the cathode of silicon controlled rectifier (SCR) or electronic switching means 172; terminal 10 is connected to terminal 12; output terminal 11 is connected to the gate of SCR 172; and terminal 14 is connected to a 5 v source of DC power from the power supply circuit 200. These interconnections of the NOR gate terminals convert the NOR gate to a sequential amplifier. In standard operation, when the working voltage is present across the lamp, the voltage divider resistors are so chosen that the filtered signal which is applied to input terminal 1 has too low a magnitude to generate any gate trigger signal at terminal 11. Put another way, the output signal of the NOR gate 174 will be zero, because the filtered input signal is below the threshhold value needed to turn the NOR gate on. The lack of a trigger signal causes the SCR to be non-conducting. Therefore, no current signal $S_c$ is generated, and no current will flow through heater winding 129. Contacts 131 and 132 will remain closed, and the ballast-starter circuit will remain connected to the power lines 156*a*, *b*. The lamp will continue to operate.

The above-described standard operation depends, of course, upon the power supply circuit 200 delivering the 5 v to terminal 14 of the NOR gate, and also upon the timer-switch circuit 150 allowing the filtered signal to enter terminal 1 of the NOR gate. The power supply circuit comprises a voltage-dropping resistor 199 which lowers the input line voltage, and a diode 198 which rectifies the incoming AC voltage and supplies an unregulated DC voltage on the order of 15 v to the voltage regulator 205. Capacitor 196 protects diode 198 from surges. Capacitor 197 filters the DC to the voltage regulator 205. Resistors 191, 193 and capacitor 194 are connected across the terminals of the voltage regulator 205, as illustrated, which is a standard integrated circuit chip (723). An 8 v regulated DC bias signal is generated at the output terminal of the regulator. This 8 v DC signal is fed to the timer 210 to supply bias to the latter, and is also fed through voltage-dropping resistor 182 to supply the required 5 v DC bias to terminal 14 of the NOR gate. Bias resistor 176 is connected between resistor 182 and ground wire 169.

As for the timer-switch circuit 150, this comprises a timer 210 which is a standard integrated circuit chip (555) having eight terminals, and an electronic switch or transistor 178. Terminal 1 is connected to grounding wire 169; terminal 5 is connected to ground through bypass capacitor 188; terminals 6 and 7 are connected together and also to both time constant resistor 184 and time constant capacitor 186; output terminal 3 is connected to the base of transistor 178 via a current-limiting resistor 180; terminal 8 is connected to the 8 v bias voltage source; and input terminal 2 is connected to both starting pulse capacitor 190 and voltage-dropping resistor 192.

During long-term steady-state operation, timer 210 generates no timer signal. Put another way, the timer signal at output terminal 3 has a zero magnitude. Consequently, no current will flow into the base of transistor switch 178. This causes the switch 178 to open and terminal 215 sees an open circuit looking back towards the transistor. This open-circuit condition allows the filtered signal to enter terminal 1 of the NOR gate.

In the event of a cycling malfunction due to lamp aging, the increased arc tube voltage is sensed by the voltage divider. The above-described operation of the regulator 205, timer 210 and switch 178 remain in effect. Therefore, the filtered signal from the diode 165 enters terminal 1 of the NOR gate. Now this filtered signal has a magnitude which is higher than the threshhold magnitude of the NOR gate. The NOR gate which, as noted above, essentially acts like a sequential amplifier with high gain will generate a trigger signal $S_t$ which, in turn, will cause the SCR to conduct the current signal $S_c$. The current signal flows through a heater 129 and, after about a 45 second time delay, the switch 130 will trip and contact between contacts 131, 132 will be broken. The ballast is disconnected from the power source and the lamp is disconnected from the circuit.

A power failure as short as three cycles will cause the lamp to extinguish. The lamp generally requires approximately two to three minutes to cool down before it can restrike. During this time, the ballast supplies the ballast open circuit voltage across the lamp, and this above-normal voltage is detected by the voltage divider resistors 161, 162. If the detector circuit 160 cannot discriminate between a power malfunction and a cycling malfunction, then the cut-off relay 130 will be tripped open every time there is a power malfunction of even a very short duration.

To prevent such inadvertent tripping, a time delay is actuated after each power failure. Upon power resumption, regulator 205 will re-establish the 8 v DC signal needed to drive the other circuits. When the 8 v DC returns, the 8 v DC signal is immediately applied to terminal 8 of timer 210 and, after a short time delay caused by the series combination of resistor 192 and capacitor 190, the 8 v DC signal is thereupon applied to terminal 2 of the timer. This short time delay is due to the fact that the voltage across capacitor 190 does not change instantaneously. This delayed application of the 8 v signal to the terminal 2 relative to the terminal 8 will reset the timer. The timer will then conduct for a predetermined time period, e.g. five minutes. Thus, a timer signal at output terminal 3 will enter the base of transistor 178 to turn on the latter. A short circuit appears between the collector and the emitter of switch 178. Terminal 215 is, therefore, connected to grounding wire 169, and any possible filtered signal coming from diode 165 is shunted to ground before ever reaching input terminal 1 of the NOR gate.

For this five minute time period, there is no input to the NOR gate; the SCR will not conduct; the heater 129 will not heat; and contacts 131, 132 will remain closed. After a short charging time, capacitor 190 will recharge, and timer 210 will not be reset. After this five minute time period has expired, the timer will no longer generate a timer signal having a positive magnitude, but instead will generate a timer signal having a zero magnitude. Switch 178 will open-circuit again and the overall system is now returned to standard operation. The structure and function of the timer-switch 210 as discussed above in connection with FIG. 2 is analogous to the timer-switch 50 of FIG. 1.

Inasmuch as cut-off relay switch 30 is identical in structure to switch 130, it is believed to be sufficient to describe only the structure and function of switch 30. Therefore, turning now to FIGS. 3 and 4, it will be seen that heater winding 29 is coiled around latching member 52 which is a bi-metallic switch composed of two thin strips of different metals **52*a*, 52*b* bonded one against the other to form a composite strip. Latching member 52 has an elongated body portion 50 having one end region fixedly mounted on electrically-insulating synthetic plastic material block 49 by fasteners 51. The other end region 50' is bent at approximately a right angle to body portion 50**.

Another latching member 38 is formed with a recess 39 which receives bent portion 50'. As shown in the working state of FIG. 1, the two latching members 52, 38 are coupled together. When a current signal passes through resistive winding 29, latching member 52 will move upwardly away from latching member 38 due to the heat generated within winding 29 from the coupled position illustrated in FIG. 1 to the uncoupled position illustrated in FIG. 2.

Latching member 38 is mounted on L-shaped bracket 37 for sliding movement relative to the latter and relative to latching member 52. One end region of bracket 37 is fixedly mounted on block 49 by fasteners 51; and the opposite end region 48 of bracket 37 is bent upwardly in generally parallel relationship to bent region 50'. Bent region 48 is formed with a clearance passage through which stem 36 passes with clearance. One end of stem 36 is connected to latching member 38; and a manual reset push button or knob 35 is mounted on the opposite end of stem 36. Biasing means or tension spring 34 surrounds stem 36 intermediate bent region 48 and the underside of knob 35.

Figure 3:
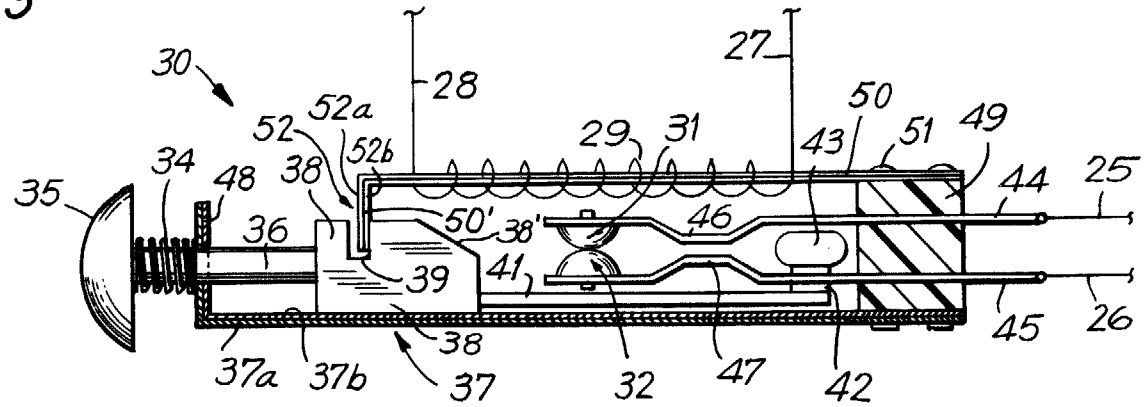
FIG. 3 is an enlarged, broken-away, partially sectional view of the cut-off switching means of either of the embodiments of FIGS. 1 and 2 in one operative condition.
Figure 4:
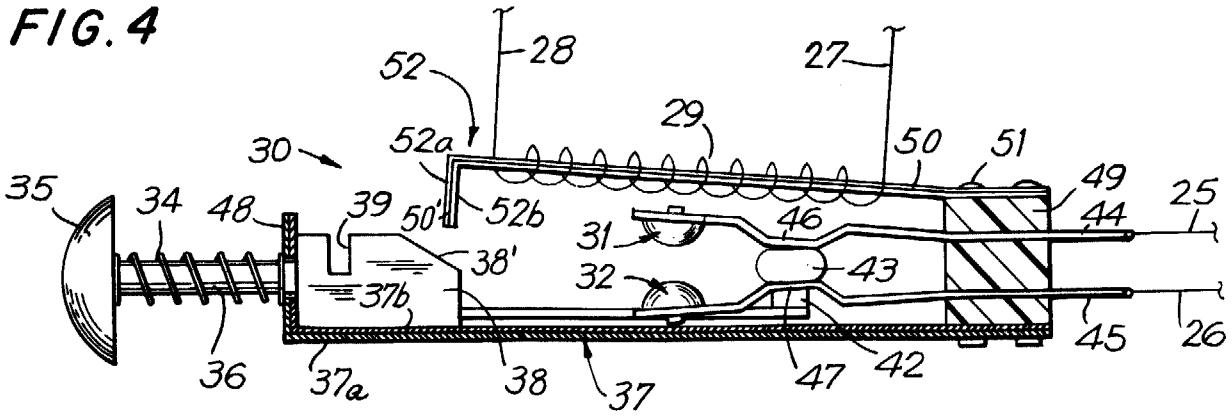
FIG. 4 is a view analogous to FIG. 3 showing the cut-off switching means of FIG. 3 in another operating condition.

After the latching members have been uncoupled from each other, the spring 34 is operative to displace latching member 38 from its FIG. 3 position to the remote position shown in FIG. 4. The spring 34 is also operative to maintain the latching member 38 in this remote position until a serviceperson comes along and manually pushes the knob 35 against the restoring force of the spring 34 to thereby re-establish the coupling relationship between the latching members. A tapered surface 38' is provided on latching member 38 to facilitate the movement of latching member 38 past the bent region 50'.

Contacts 31 and 32 are shown in their normally electrically-conducting position in FIG. 3. After uncoupling of the latching members, breaker means are provided on the displaceable latching member 38 to move along with the latter. Thus, breaker element 43 which is generally elliptically shaped is mounted on post 42 which, in turn, is mounted on elongated support 41 which is mounted on latching member 38 for movement with the same. Breaker element 43 forces armature portion 46, 47 and contacts 31, 32 to move respectively away from each other upon displacement of the latching member 38. FIG. 4 shows the latched cut-off state with electrical contact between contacts 31, 32 interrupted. Armature terminals 44, 45 are embedded in block 49 and are respectively electrically connected to conductors 25, 26.

In the event of abnormally warm weather conditions, it is possible that the bi-metallic latching element 52 may move out of recess 39 due to ambient weather conditions, rather than as a result of a cycling malfunction. To avoid this problem, bracket 37 is constituted as a bi-metallic strip having two thin metallic strips **37*a*, 37*b* bonded one against the other to form a composite strip. Now, if warm weather tends to move latching element 52 in an upward direction, then the bracket 37 will likewise move upwardly and concomitantly move latching member 38 in upward direction. Any undesired movement of latching member 52 will, therefore, be tracked by latching member 38** to thereby compensate for warm weather conditions.

We have found that the following component values are preferred for the FIG. 2 embodiment:

| ELEMENT (Reference Numeral) | COMPONENT VALUE |
|---|---|
| 199 | 6.7K Ω |
| 198 | IN 4007 |
| 196 | .01 uf |
| 197 | 8MFD |
| 205 | Integrated circuit 723 (e.g. RCA CA 723) |
| 191 | 4.7K Ω |
| 193 | 39K Ω |
| 194 | 100 pf |
| 192 | 22K Ω |
| 190 | 2.2 uf |
| 210 | Integrated circuit 555 (e.g. RCA CA 555) |
| 188 | .01 uf |
| 184 | 2.2M Ω |
| 186 | 100 uf |
| 180 | 56K Ω |
| 178 | 2N3903 |
| 161 | 120K Ω |
| 162 | 5K Ω |
| 164 | .01 uf |
| 165 | IN 4001 |
| 166 | 68K Ω |
| 164' | 47 MFD |
| 174 | Integrated circuit CD 4001 (e.g. RCA CD 4001) |
| 182 | 10K Ω |
| 176 | 18K Ω |
| 172 | C-106 |
| 129 | 4.2K Ω |

Of course, the cycling cut-off arrangement need not only be operative in the cycling malfunction situation described above, but may also be operative to sense whenever the voltage across the lamp exceeds a predetermined voltage value. This predetermined value may be selected to be less than the voltage which exists across the extinguished lamp in the event of a cycling malfunction. Preferably, the ballast-starter is selected in order to operate the associated lamp within industrially-specified wattage and voltage ratings. At the user's option, the lamp can be cut off whenever the lamp exceeds the aforementioned ratings. In this case, the sensing of the lamp voltage above the predetermined value can be used to indicate that the lamp output or efficiency is no longer at its normal rating, that the user may wish to change lamps at this time, as well as the fact that a cycling malfunction may be imminent. The user maintains the option of operating the cut-off arrangement for cycling purposes, or for the purpose of indicating an unacceptable loss of efficiency for his lighting system.

It will be understood that each of the elements described above, or two or more together, may also find a useful application in other types of constructions differing from the types described above.

While the invention has been illustrated and described as embodied in a cut-off arrangement for and method of protecting a ballast-starter circuit from high pressure sodium lamp cycling malfunction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a luminaire of the type having a high pressure sodium lamp, a source of electrical power, and ballast-starter means normally connected to the power source and operative for supplying voltage of predetermined magnitude across the lamp to operate the latter, a cycling cut-off arrangement for protecting the ballast-starter means from damage in the event of a cycling malfunction wherein the lamp is extinguished and the ballast-starter means applies a voltage of magnitude greater than said predetermined magnitude across the extinguished lamp, comprising (a) sensor means for detecting the magnitude of the voltage across the extinguished lamp, and for generating an electrical current signal when the magnitude of the voltage across the extinguished lamp reaches a threshold magnitude which is greater than said predetermined magnitude; and (b) means responsive to the generation of the electrical current signal for disabling the power source from the ballast-starter means to thereby protect the latter from damage in the event of a cycling malfunction.

2. The cycling cut-off arrangement of claim 1, wherein said sensor means includes means for electronically generating an electrical trigger signal, and electrical switching means operative for generating the electrical current signal in response to generation of said electrical trigger signal; and wherein said disabling means includes timer means for generating a timer signal having two magnitudes, and cut-off means operative in response to generation of the electrical current signal and one of the magnitudes of the timer signal for switching the ballast-starter means from a working state in which the ballast-starter means is connected to the power source, to a cut-off state in which the ballast-starter means is disconnected from the power source.

3. The cycling cut-off arrangement of claim 2, wherein said electrical trigger signal generating means includes a zener diode having a diode input operatively connected to the lamp, and a diode output, said zener diode generating the trigger signal only when the voltage of threshhold magnitude is detected; and wherein said electrical switching means includes a transistor having a transistor input operatively connected to said diode output, and a transistor output operatively connected to said cut-off means, said transistor generating the electrical current signal only when the trigger signal is applied to said transistor input.

4. The cycling cut-off arrangement of claim 2, wherein said electrical trigger signal generating means includes a diode operatively connected to the lamp, and a NOR gate operatively connected in series with said diode, said NOR gate generating the trigger signal only when the voltage of threshhold magnitude is detected; and wherein said electrical switching means includes a silicon controlled rectifier having a control input operatively connected to said NOR gate, and a rectifier output operatively connected to said cut-off means, said rectifier generating the electrical current signal only when the trigger signal is applied to said control input.

5. The cycling cut-off arrangement of claim 2, wherein said cut-off means includes a pair of latching members in coupled relationship with each other in said working state, and means for moving one of said latching members relative to the other of said latching members in response to generation of the electrical current signal to thereby uncouple said latching members in said cut-off state.

6. The cycling cut-off arrangement of claim 5, wherein said one latching member is a bimetallic heating strip, and wherein said moving means includes a heater coil electrically connected to said electrical switching means and surrounding said bimetallic strip to thereby heat and move the latter after a predetermined time interval relative to said other latching member.

7. The cycling cut-off arrangement of claim 5, wherein said cut-off means further includes a pair of contacts in electrically-conductive contact with each other in said working state; and means for displacing said other latching member to a remote position away from said one latching member upon uncoupling of said latching members, and also for maintaining said other latching member in said remote position; and means on and displaceable with said other latching member for breaking electrically-conductive contact between said contacts, and also for maintaining said contacts in non-electrically-conductive relationship during said cut-off state.

8. The cycling cut-off arrangement of claim 7; and further comprising reset means for re-establishing the coupled relationship between said latching members and the electrically-conductive contact between said contacts.

9. The cycling cut-off arrangement of claim 8, wherein said cut-off means further comprises a bracket on which said other latching member is mounted for displacement, and wherein said reset means comprises a hand-operated push button on said other latching members and operative for displacing the latter when pushed.

10. The cycling cut-off arrangement of claim 9, wherein said bracket is a bimetallic heating strip similar to said one latching member to thereby compensate for movement of the latter in the event of a heated ambient atmosphere surrounding said cut-off means and causing undesired movement of said one latching member.

11. The cycling cut-off arrangement of claim 2, wherein said timer means comprises a timer switch operatively connected to said cut-off means and operative for switching between a first switching condition in which said one magnitude of the timer signal is generated and said cut-off means is operative for switching between said states, and a second switching condition in which the other of the magnitudes of the timer signal is generated and said cut-off means is inoperative, said second switching condition lasting for a predetermined time period which begins upon power resumption after a power malfunction of duration less than said predetermined time period, whereby disablement of the ballast-starter means is prevented in the event of a power malfunction.

12. The cycling cut-off arrangement of claim 11, wherein said timer means includes a transistor switch operative for preventing said sensor means from generating the electrical trigger signal.

13. A method of protecting from damage a ballast-starter means of a luminaire of the type having a source of power normally connected to the ballast-starter means, and a high pressure sodium lamp across which the ballast-starter means supplies voltage of predetermined magnitude to thereby operate the lamp, in the event of a cycling malfunction wherein the lamp is extinguished and the ballast-starter means applies a voltage of magnitude greater than said predetermined magnitude across the extinguished lamp, the method comprising the steps of:

(a) detecting the magnitude of the voltage across the extinguished lamp, and generating an electrical current signal when the magnitude of the voltage across the extinguished lamp reaches a threshhold magnitude which is greater than said predetermined magnitude; and (b) disabling the power source from the ballast-starter means in response to the generation of the electrical current signal to thereby protect the ballast-starter means from damage in the event of cycling malfunction.

14. The method of claim 13, wherein said step of detecting includes the step of generating an electrical trigger signal, and wherein said step of generating the electrical current signal is performed in response to generation of the electrical trigger signal; and wherein said disabling step includes the step of generating a timer signal having two magnitudes, and the step of switching the ballast-starter means from a working state in which the latter is connected to the power source, to a cut-off state in which the ballast-starter means is disconnected from the power source in response to generation of the electrical current signal and one of the magnitudes of the timer signal.

15. The method of claim 14, wherein said switching step maintains said cut-off state; and further comprising the step of manually re-establishing said working state.

16. The method of claim 14, wherein said step of generating the timer signal includes the step of generating said one magnitude of the timer signal to thereby permit switching between said states, and the step of generating the other of the magnitudes of the timer signal to thereby prevent switching between said states for a predetermined time period which begins upon power resumption after a power malfunction of duration less than said predetermined time period, whereby disablement of the ballast-starter means is prevented in the event of a power malfunction.

17. In a luminaire of the type having a high pressure sodium lamp, a source of electrical power, and ballast-starter means normally connected to the power source and operative for supplying voltage of predetermined magnitude across the lamp to operate the latter, a cut-off arrangement for protecting the ballast-starter means from damage in the event that the voltage across the lamp exceeds said predetermined magnitude, comprising (a) sensor means for detecting the magnitude of the voltage across the lamp, and for generating an electrical current signal when the magnitude of the voltage across the lamp reaches a threshhold magnitude which is greater than said predetermined magnitude; and (b) means responsive to the generation of the electrical current signal for disabling the power source from the ballast-starter means to thereby protect the latter from damage.

18. A method of protecting from damage a ballast-starter means of a luminaire of the type having a source of power normally connected to the ballast-starter means, and a high pressure sodium lamp across which the ballast-starter means supplies voltage of predetermined magnitude to thereby operate the lamp, in the event that the voltage across the lamp exceeds said predetermined magnitude, the method comprising the steps of:

(a) detecting the magnitude of the voltage across the lamp, and generating an electrical current signal when the magnitude of the voltage across the lamp reaches a threshhold magnitude which is greater than said predetermined magnitude; and (b) disabling the power source from the ballast-starter means in response to the generation of the electrical current signal to thereby protect the ballast-starter means from damage.

* * * * *